US009263828B2

(12) United States Patent
Kuo

(10) Patent No.: US 9,263,828 B2
(45) **Date of Patent: *Feb. 16, 2016**

(54) MAGNETIC POWER CONNECTOR AND AN ELECTRONIC SYSTEM USING THE MAGNETIC POWER CONNECTOR ASSEMBLY

(71) Applicant: SINGATRON TECHNOLOGY (HongKong) CO., LIMITED, New Territories (HK)

(72) Inventor: Ronghsun Kuo, New Territories (HK)

(73) Assignee: Singatron Technology (Hong Kong) Co., Limited, New Territories (HK)

( * ) Notice: Subject to any disclaimer, the term of this patent is extended or adjusted under 35 U.S.C. 154(b) by 87 days.

This patent is subject to a terminal disclaimer.

(21) Appl. No.: 14/183,546

(22) Filed: Feb. 19, 2014

(65) Prior Publication Data

US 2014/0256162 A1 Sep. 11, 2014

(30) Foreign Application Priority Data

| | | |
|---|---|---|
| Mar. 8, 2013 | (TW) | 102204350 U |
| Mar. 8, 2013 | (TW) | 102204353 U |
| Mar. 15, 2013 | (TW) | 102204773 U |
| Mar. 22, 2013 | (TW) | 102205346 U |

(51) Int. Cl.

| | |
|---|---|
| ***H01R 11/30*** | (2006.01) |
| ***H01R 13/62*** | (2006.01) |
| ***H01R 13/703*** | (2006.01) |
| *H01R 13/24* | (2006.01) |

(52) U.S. Cl.

CPC ..... *H01R 13/6205* (2013.01); *H01R 13/7031* (2013.01); *H01R 13/2421* (2013.01)

(58) Field of Classification Search

CPC ..... H01R 13/6205; H01R 13/2421
USPC ..... 439/39, 700, 289
See application file for complete search history.

(56) References Cited

U.S. PATENT DOCUMENTS

| | | | | |
|---|---|---|---|---|
| 3,274,534 | A * | 9/1966 | Shortridge | 439/700 |
| 3,431,428 | A * | 3/1969 | Van Valer | 307/10.1 |
| 5,447,442 | A * | 9/1995 | Swart | 439/77 |
| 5,921,783 | A * | 7/1999 | Fritsch et al. | 439/38 |
| 7,077,709 | B1 * | 7/2006 | Shin-Ting | 439/700 |
| 7,351,066 | B2 * | 4/2008 | DiFonzo et al. | 439/39 |
| 7,467,948 | B2 * | 12/2008 | Lindberg et al. | 439/38 |
| 8,337,256 | B1 * | 12/2012 | Lin | 439/700 |
| 9,004,924 | B2 * | 4/2015 | Kuo | 439/39 |

* cited by examiner

*Primary Examiner* — Neil Abrams
(74) *Attorney, Agent, or Firm* — Min-Lee Teng; Litron Patent & Trademark Office

(57) ABSTRACT

A magnetic power connector and an electronic system using a magnetic power connector assembly are disclosed, wherein a magnetic element of the magnetic power connector is magnetically attracted to a matching magnetic connector to ensure a stable contact. In addition, the electrical conductive path created between the contact elements does not pass through any elastic elements, thereby avoiding heating and improving the lifespan of the elements. Furthermore, sealing member can be disposed in the gaps between the connector elements to make the connector waterproof. In addition, a trigger signal can be generated by establishing an electrical connection between a signal contact element and the conductive element in the magnetic power connector so as to achieve the purpose of identification or control, thereby avoiding the functional failure caused by the damage of the contact element of the matching magnetic connector.

36 Claims, 14 Drawing Sheets

MAGNETIC POWER CONNECTOR AND AN ELECTRONIC SYSTEM USING THE MAGNETIC POWER CONNECTOR ASSEMBLY

BACKGROUND OF THE INVENTION

I. Field of the Invention

The present invention relates to a magnetic connector and in particular to a magnetic connector for electrically connecting an electrical relation to an electronic device.

II. Descriptions of the Prior Art

Please refer to patent document TW M451694 (referred as Prior Art 1 hereafter), wherein a connecting structure is disclosed. The connecting structure includes a metal cylinder, a spring and a metal pin. The metal cylinder comprises a cylindrical shell body and a space inside the shell body to accommodate the spring and the pin, wherein one end of the spring is in contact with the bottom base of the metal cylinder and the other end of the spring is in contact with the metal pin.

In the prior art 1, a conductive path can be formed when the metal pin is in contact with the spring or the metal cylinder. However, when the metal pin is forced to move into the space inside the cylindrical shell body, the contact of the metal pin and the metal cylinder may not be stable due to the manufacturing tolerance of the metal pin. In addition, current flowing through the spring is not stable due to the length and deformation of the spring that causes rapid resistance changes in the spring, thereby affecting the signal transmission quality. In the long run, the lifespan of the spring is shortened by the heat generated by the current flowing in the spring.

Please refer to patent document TW 1365574 (referred as Prior Art 2 hereafter) which discloses a cell connector. The cell connector comprises a case and a plurality of connection modules. The connection module includes comprises a pin, an electric conduction medium and a spring. A connecting end of the pin extends out of the case and the electric conduction medium comprises a plurality of elastic parts. The elastic parts are in direct contact with the pin continually for conducting current. One end of the spring extends into the space inside the pin and the other end of the spring is against the electric conduction medium.

Although, in the Prior Art 2, the pin can maintain direct contact with the electric conduction medium to allow current to flow through the pin to the electric conduction medium without using the spring, because the spring is made of metal, the current will also flow through the spring to the electric conduction medium, which will shorten the lifespan of the spring due to the heat generated by the current flowing through the spring.

Please refer to U.S. Pat. No. 7,311,526 (referred as Prior Art 3 hereafter) which discloses an identification circuitry inside an adapter. When the adapter is connected, the identification circuitry can identify the type of electronic device, or even a specific device for a particular purpose. The adapter is connected to an electronic device through a plug and a receptacle. When the user positions the plug against the receptacle, a signal path formed by the contacts allows the identification circuitry to send a signal to the internal circuits of the device for identifying the connection of the adapter and the electronic device or achieve other control purposes.

In the prior art 3, a functional failure associated with the identification circuitry can occur when the contact of the plug or receptacle is damaged and the signal path cannot be formed.

The present invention aims to resolve the issues mentioned above.

SUMMARY OF THE INVENTION

One object of the present invention is to provide a magnetic power connector which can improve the lifetime of the contact elements.

One object of the present invention is to provide a magnetic power connector which can reduce the impact of impulses to an electronic device.

One object of the present invention is to provide a magnetic power connector which is waterproof.

The present invention provides a magnetic power connector and an electronic system using a magnetic power connector assembly, which can achieve identification or control purposes by utilizing a single connector to avoid functional failure caused by damage to the contact elements of matching magnetic connector.

The present invention discloses a magnetic power connector for electrically connecting to a matching magnetic connector between an electronic device and an electrical relation connectable to a power source, the matching magnetic connector comprising a second magnetic element and at least one contact element, wherein the magnetic power connector comprises: an insulation body, at least one movable contact element disposed in the insulation body and a first magnetic element; wherein the movable contact element comprises a conductive element, an insulation block, an elastic element and an elastic conductive element, wherein one end of the conductive element is coupled to the insulation block and the insulation block is pressed against the elastic element so as to move the conductive element inside the insulation body elastically, wherein one end of the elastic conductive element can be elastically against a peripheral side of the conductive element.

When the magnetic power connector and the matching magnetic connector are connected, magnetic attraction between the first and second magnetic elements causes the movable contact element being pressed by the contact element to move towards the elastic element so as to form a conductive path through the contact element, the conductive element and the elastic conductive element, between the electronic device and the electrical relation.

In addition, when there is a plurality of movable contact elements, at least one positive contact element and at least one negative contact element can be defined, and the negative contact element comes into contact with the contact element prior to the positive contact element when the magnetic power connector and the matching magnetic connector are connected, to ensure that impulses can be conducted to a ground by the negative contact element to lower the possibility of damaging the electronic device due to the impulses.

The magnetic power connector further comprises a shell covering the first magnetic element, and a sealing member disposed between the shell, the insulation body and the first magnetic element or between the insulation body and the movable contact element; the shell or the sealing member can also be disposed on the matching magnetic connector.

The present invention also discloses an electronic system with a magnetic power connector assembly, wherein the electronic system comprises: an electronic device, a magnetic power connector, a matching magnetic connector, and an electrical relation, wherein electronic device has a case having a opening thereon, and wherein the magnetic power connector comprises an insulation body, at least one movable contact element disposed in the insulation body, and a first magnetic element, wherein the movable contact element comprises a conductive element, an insulation block, an elastic element and an elastic conductive element, wherein one end of the conductive element is coupled to the insulation block, and the insulation block is elastically pressed against the elastic element so as to move the conductive element in the insulation body elastically, wherein one end of the elastic conductive element can be elastically against a peripheral side surface of the conductive element; and wherein the matching magnetic connector is connectable to the magnetic power connector, the matching magnetic connector comprising a second magnetic element and at least one contact element; and wherein the electrical relation is connectable to a power source.

In the above electronic system, the magnetic power connector and the matching magnetic connector are electrically connected between the electronic device and the electrical relation; and the magnetic power connector or the matching magnetic connector is disposed in the case, and the first or second magnetic element is exposed in the opening correspondingly, wherein when the magnetic power connector and the matching magnetic connector are connected, magnetic attraction between the first and second magnetic elements causes the movable contact element being pressed by the contact element to move towards the elastic element so as to form a conductive path through the contact element, the conductive element and the elastic conductive element, between the electronic device and the electrical relation.

Further, a trigger signal can be generated by establishing an electrical connection between a signal contact element and the conductive element in the magnetic power connector so as to achieve the purpose of identification or control, wherein the movable contact element and the signal contact element are in a first electrical connection status when they are electrically connected, and the movable contact element and the signal contact element are in a second electrical connection status when they are electrically disconnected; the purpose of identification or control can be achieved simply by using the electrically connection relationships between the internal elements of magnetic power connector, to avoid the functional failure caused by the damage of the contact element of the matching magnetic connector.

The present invention discloses an insulation block disposed on the movable contact element to insulate the conductive element and the elastic element. A conductive path can only be formed between the conductive element and the elastic conductive element, therefore avoiding heating and improving the lifespan of the contact element. In addition, the connector and the electronic device can be made waterproof by a sealing member disposed in the gaps of the connector.

DETAILED DESCRIPTION

Figure 1:
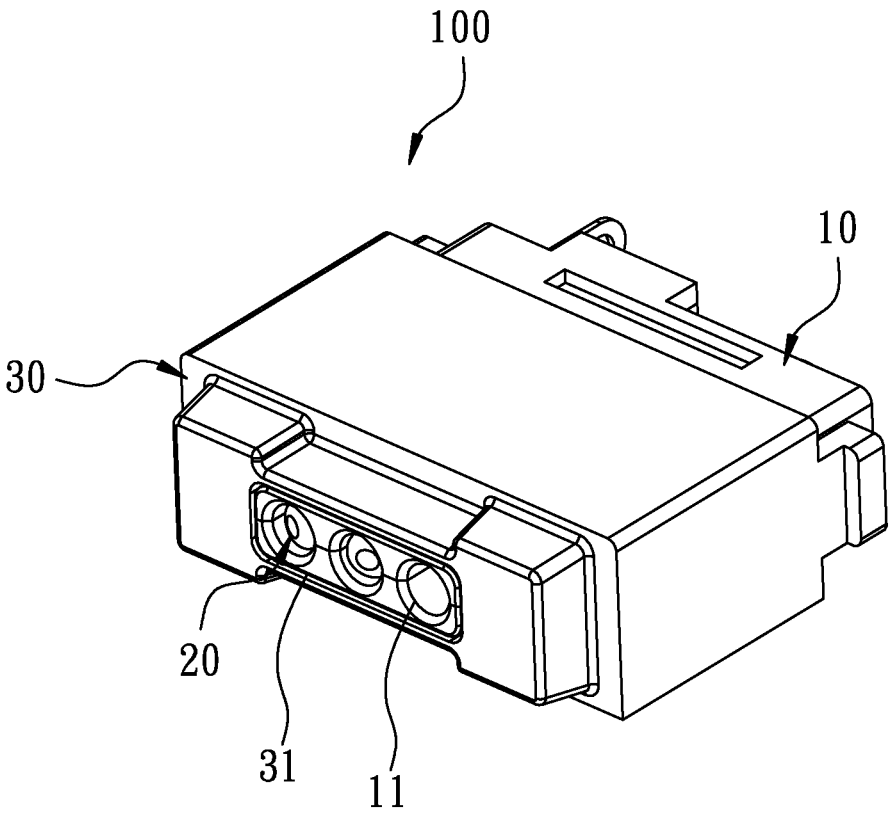
FIG. 1 illustrates a three dimension view of a magnetic power connector of the first embodiment of present invention.
Figure 2:
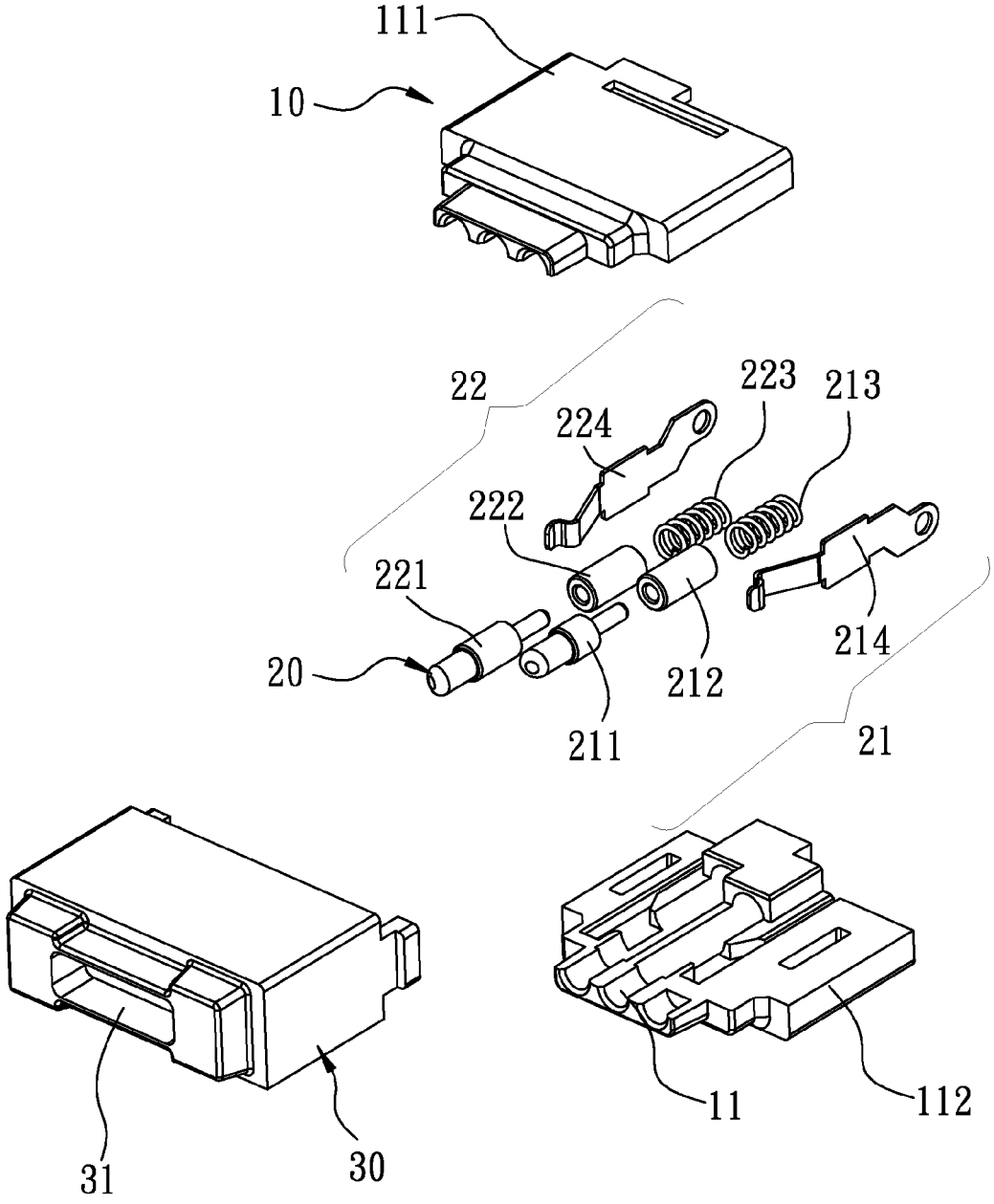
FIG. 2 illustrates an exploded view of the magnetic power connector of the first embodiment of present invention.

FIGS. 1 and 2 illustrate the magnetic power connector of the first embodiment of present invention. In FIG. 1 and FIG. 2, a magnetic power connector 100 comprises:

an insulation body 10 having at least one passage 11. In the current embodiment, the insulation body 10 comprises a first insulation body 111 and a second insulation body 112, the first insulation body 111 and the second insulation body 112 are assembled together and two passages 11 are formed therebetween.

Figure 3:
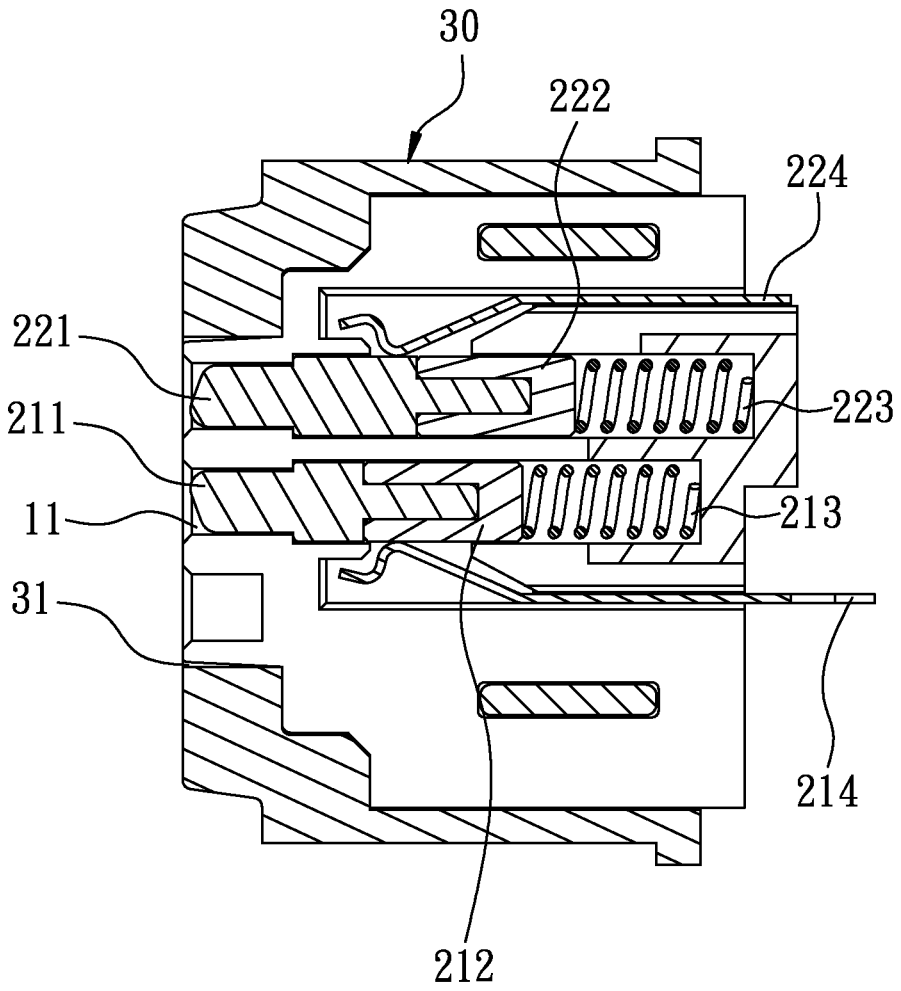
FIG. 3 illustrates a section view of the magnetic power connector according to the first embodiment of present invention.

At least one movable contact element 20 is disposed in the passage 11. In the current embodiment, two movable contact elements 20 are disposed respectively in the passages 11. The movable contact elements 20 define a positive contact element 21 and a negative contact element 22. Each of the positive contact element 21 and the negative contact element 22 respectively includes: a conductive element 211, 221, an insulation block 212, 222, an elastic element 213, 223 and an elastic conductive element 214, 224. One end of the conductive element 211, 221 is coupled to the insulation block 212, 222. The insulation block 212, 222 is elastically pushed by the elastic element 213, 223 so as to move the conductive element 211, 221 elastically inside the passages 11. One end of the elastic conductive element 214, 224 is elastically against the peripheral side surface of the conductive element 211,221; the other end of the elastic conductive element 214, 224 extends outside the insulation body 10. As shown in FIG. 3, in normal conditions, the elastic conductive element 214 of the positive contact element 21 is elastically against the insulation block 212 of the positive contact element 21, wherein when the conductive element 211 of the positive contact element 21 is pressed to move towards the elastic element 213, the elastic conductive element 214 of the positive contact element 21 will be in contact with the conductive element 211 of the positive contact element 21; and at the same time, the elastic conductive element 224 of the negative contact element 22 is permanently in contact with the conductive element 221 of the negative contact element 22.

A first magnetic element 30 disposed on the insulation body 10 covers the front end of the insulation body 10, wherein the first magnetic element 30 includes an opening 31 corresponding to the passages 11 so that the conductive elements 211,221 are exposed in the opening 31.

Figure 4:
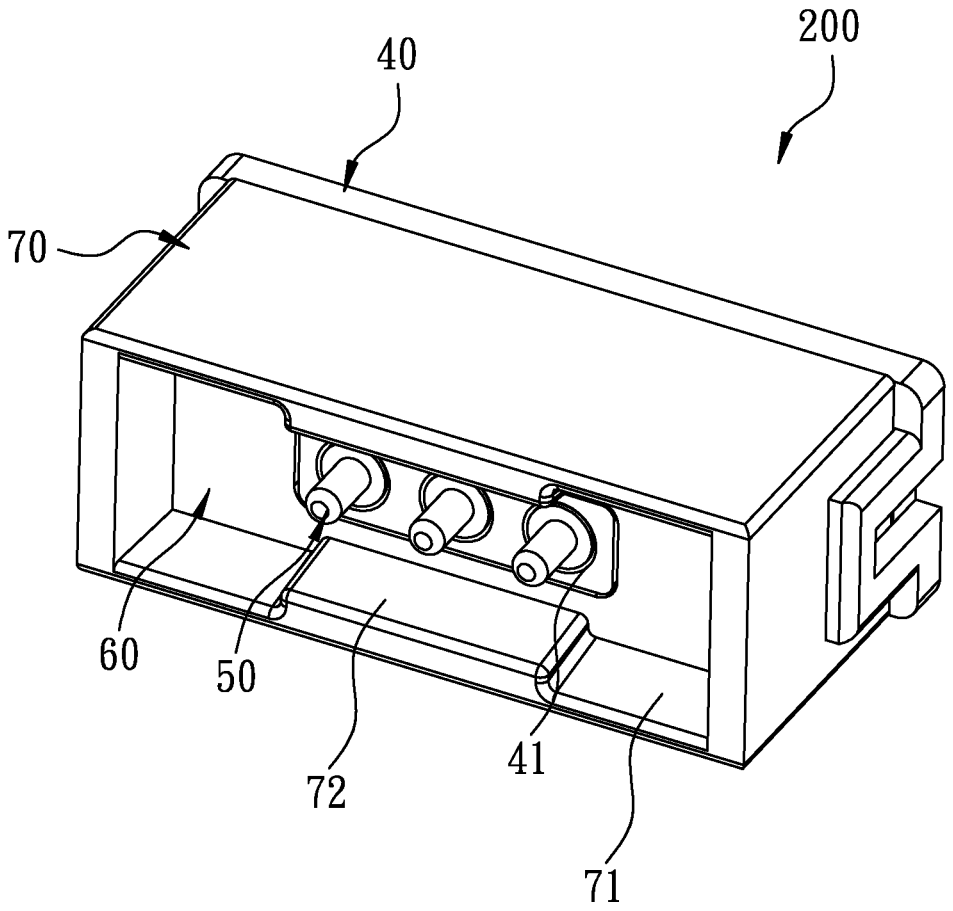
FIG. 4 illustrates a three dimension view of the matching magnetic connector according to the first embodiment of present invention.
Figure 5:
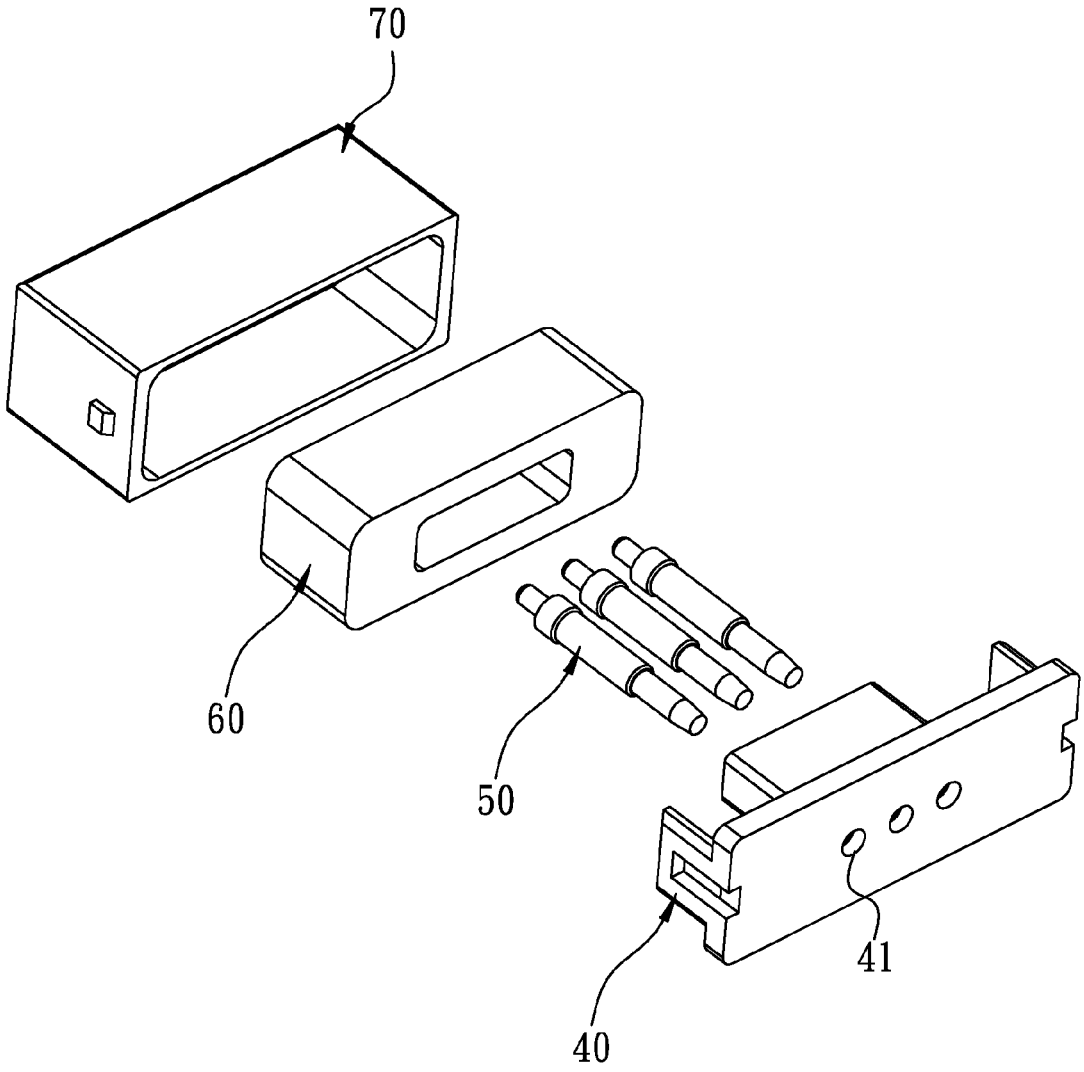
FIG. 5 illustrates an exploded view of the matching magnetic connector according to the first embodiment of present invention.

FIG. 4 and FIG. 5 illustrate a three dimension and exploded view of the matching magnetic connector according to the first embodiment of present invention. The matching magnetic connector 200 comprises:

An insulation host 40 having at least one through hole 41. In the current embodiment, the insulation host 40 is integrally formed and a plurality of through holes 41 is disposed on the center section of the insulation host 40.

At least one contact element 50 disposed in the through holes 41. In the current embodiment, three contact elements 50 are disposed respectively in the through holes 41 and partially extended outside the insulation host 40.

A second magnetic element 60 is disposed on the insulation host 40. In the current embodiment, the second magnetic element 60 integrally covers the peripheral side surface of the insulation host 40, and the contact elements 50 partially extend outside the second magnetic element 60.

A shell 70 covers the exterior of the second magnetic element 60 and couples to the insulation host 40. An opening 71 is disposed on the shell 70 for partially exposing the second magnetic element 60, and the contact elements 50 extend outside the opening 71. A first constrain part 72 of the shell 70 extrudes toward the contact elements 50 from the inside of the opening 71 of the shell 70. The shape of the first magnetic element 30 matches the shape of the opening 71 of the shell 70. In the current embodiment, the first constrain part 72 covers the contact elements 50, and the first constrain part 72 can be disposed respectively on the outermost side of the periphery of the contact elements 50.

Figure 6:
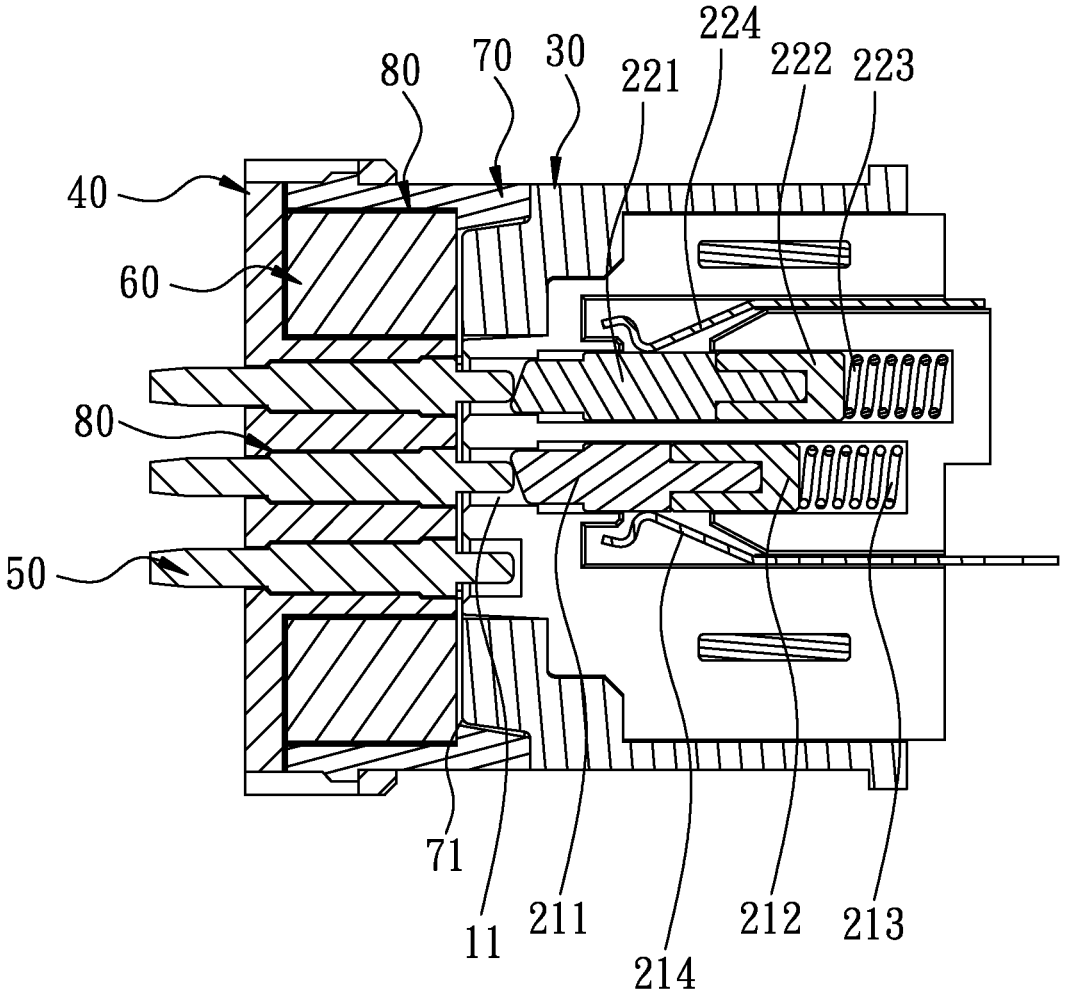
FIG. 6 illustrates the connecting status of the magnetic power connector and the matching magnetic connector according to the first embodiment of present invention.

Please refer to FIG. 6 in which a sealing member 80 is disposed between the shell 70, the insulation host 40 and the second magnetic element 60, or between the opening 41 and the contact element 50. In the current embodiment, the sealing member 80 is waterproof glue.

Please refer to FIG. 4. When operating a magnetic connector according to present invention, the matching magnetic connector 200 is brought close to the magnetic power connector 100 so that the magnetic attraction between the first magnetic element 30 and the second magnetic element 60 allows the matching magnetic connector 200 and the magnetic power connector 100 to be connected stably. Since the contact elements 50 extend out of the surface of the second magnetic element 60 and the first magnetic element 30 partially plug into the opening 71, the first constrain part 72 can stop the first magnetic element 30 from colliding into the contact elements 50 laterally and thus preventing damage. After the matching magnetic connector 200 and the magnetic power connector 100 are connected, the contact elements 50 will press against the conductive elements 211, 221 to move them towards the elastic elements 213, 223 allowing the elastic conductive element 214 to electrically connect to the conductive element 211 of the positive contact element 21. Conductive paths between the contact elements 50, the positive contact element 21 and elastic conductive element 214 will be created as well. The insulation blocks 212, 222 insulate the conductive elements 211, 221 from the elastic elements 213, 223 and thus preventing the elastic elements 213, 223 from heating because current cannot flow through the elastic elements 213, 223. In addition, as the elastic conductive element 224 of the negative contact element 22 is permanently against the conductive element 221, the negative contact element 22 electrically connects to the contact element 50 prior to the positive contact element 21. Therefore the negative contact elements 22 conduct impulses to the ground, so as to lower the possibility of damages due to the impulses.

Please refer to FIG. 6, wherein the sealing member 80 is used to seal up the gaps between the shell 70, the insulation host 40, the second magnetic element 60, or the gaps between the opening 41 and the contact element 50. When the matching magnetic connector 200 is disposed in an electronic device 300 (as shown in FIG. 10), the connector is made waterproof by preventing water from leaking into the electronic device 300 from the matching magnetic connector 200.

The movable contact elements 20 and the contact elements 50 can be permutable mutually, so the movable contact elements 20 are disposed in the matching magnetic connector 200. The sealing member 80 is disposed between the shell 70, the insulation body 10 and the first magnetic element 30, or between the passages 11 and the movable contact elements 20 (not shown), so waterproof qualities can be also achieved as described. The structures of the magnetic power connector 100 and the matching magnetic connector 200 can be also permutable mutually, so the shell 70 is disposed on the first magnetic element 30, partially exposing the first magnetic element 30 in the opening 71, and the conductive elements 211,221 extend out of the surface of the first magnetic element 30. While the second magnetic element 60 of the matching magnetic connector 200 partially inserts into the opening 71, the first constrain parts 72 can stop the second magnetic element 60 from laterally colliding into the conductive element 211, 221 (not shown), all the structures equivalent to the above-mentioned structure are within the scope of present invention as well.

Figure 7:
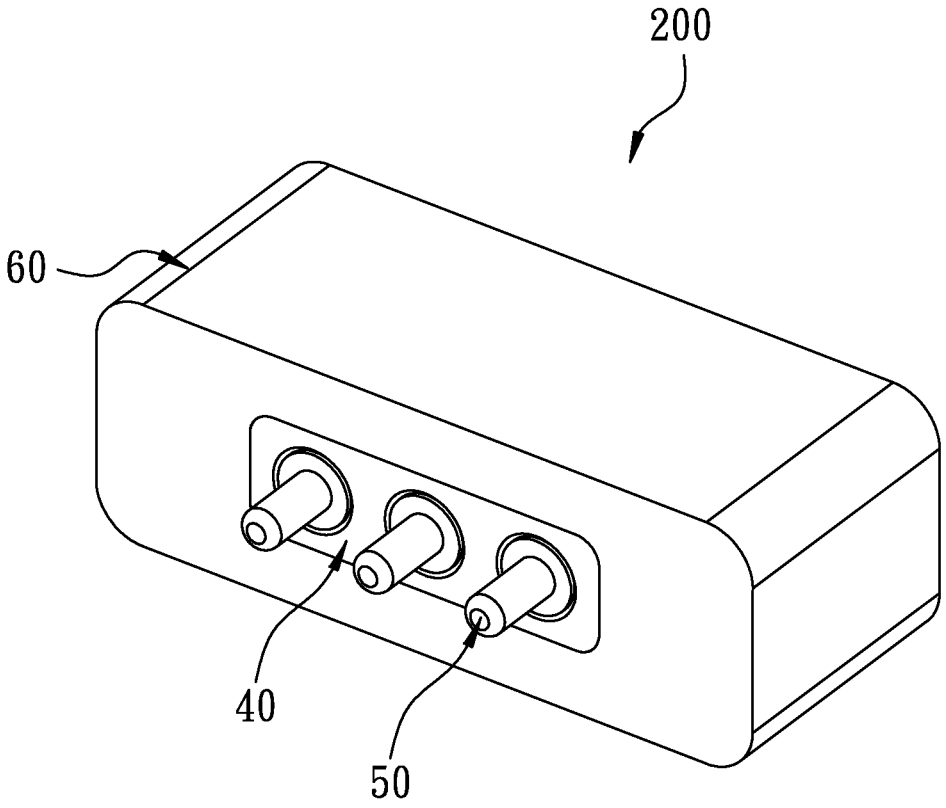
FIG. 7 illustrates three dimension view of the matching magnetic connector according to the second embodiment of present invention.
Figure 8:
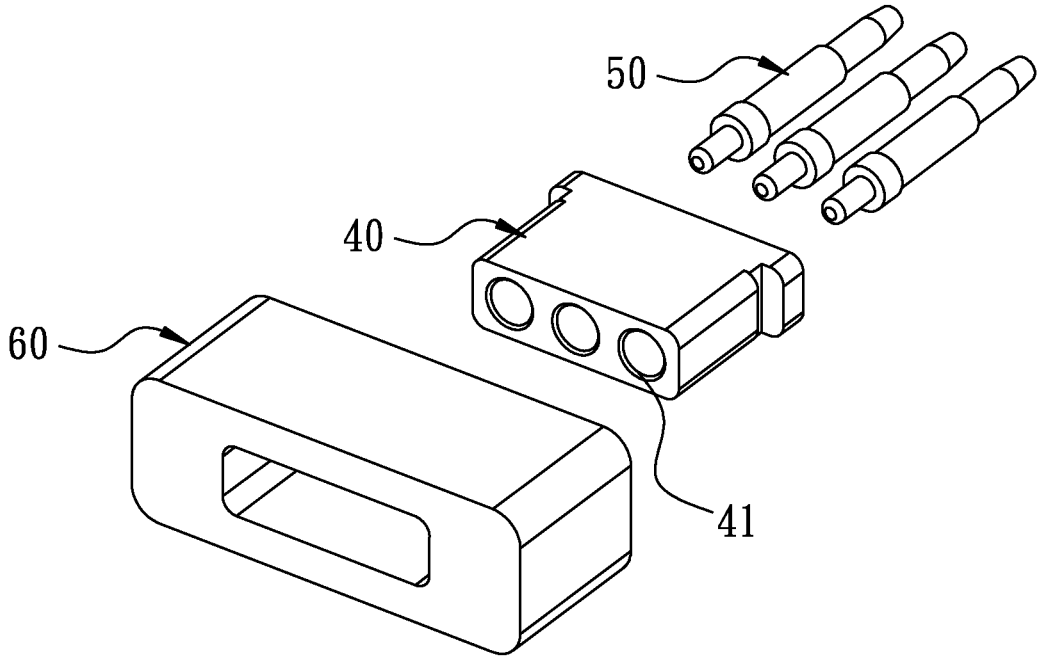
FIG. 8 illustrates an exploded view of the matching magnetic connector according to the second embodiment of present invention.

FIGS. 7 and 8 illustrate three dimension and exploded views of the matching magnetic connector of the second embodiment of present invention. The second embodiment is almost the same as the first embodiment, and the major difference between them is that the matching magnetic connector 200 does not include a shell 70 in the second embodiment and can reduce the overall volume to meet the needs for lighter and thinner product.

Figure 9:
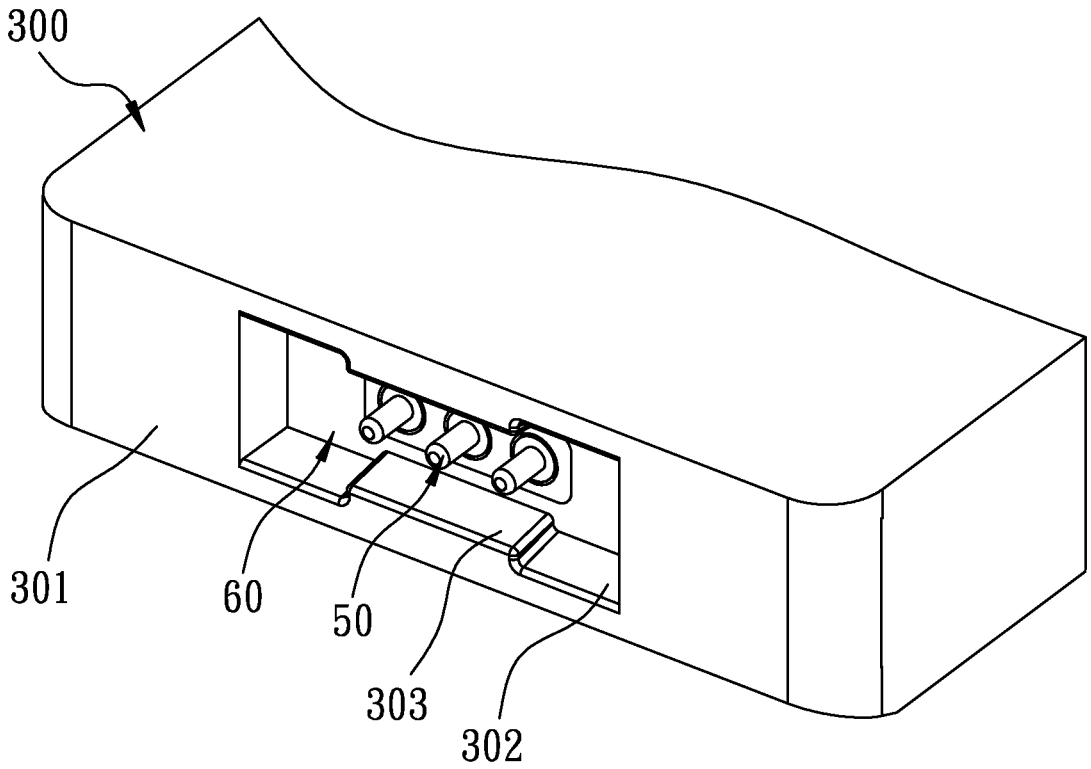
FIG. 9 illustrates a three dimension view of the matching magnetic connector assembled in a case according to the second embodiment of present invention.
Figure 10:
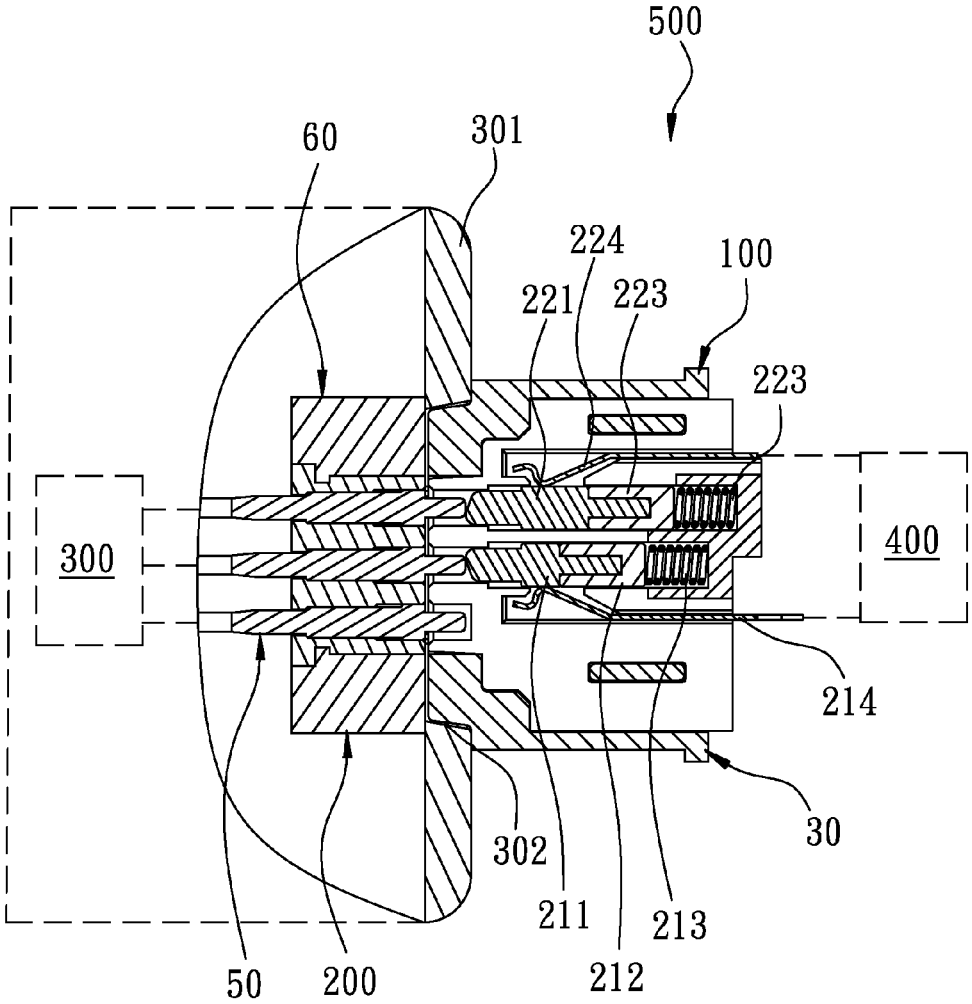
FIG. 10 illustrates the connecting status of the magnetic power connector and the matching magnetic connector according to the second embodiment of present invention.

FIGS. 9 and 10 illustrate a three dimension view and the connecting status of the matching magnetic connector disposed in a case according to the second embodiment of present invention. The matching magnetic connector 200 is directly disposed in the electronic device 300 (laptop computer, handheld device, cell phone . . . , etc.). The electronic device 300 includes a case 301 having an opening 302, and the second magnetic element 60 is correspondingly exposed in the opening 302. the contact elements 50 partially extends out of the surface of the second magnetic element 60 and is disposed in the opening 302. At least one second constrain part 303 extrudes toward the contact elements 50 from the internal sidewall of the opening 302. The second constrain part 303 covers the contact elements 50. In the second embodiment, when the magnetic power connector 100 and the matching magnetic connector 200 are coupled, the first magnetic element 30 is partially plugged into the opening 302, while the second constrain part 303 can stop the first magnetic element 30 from colliding into the contact elements 50 laterally.

Please note that the magnetic power connector 100 and the matching magnetic connector 200 can be permutable mutually. The magnetic power connector 100 can be directly disposed in the electronic device 300 (not shown) to achieve the described effects and purposes.

FIG. 10 illustrates a schematic in which the magnetic power connector 100 and the matching magnetic connector 200 are electrically connected between an electronic device 300 and an electrical relation 400 (ex: a power adapter) to form an electronic system 500. The electrical relation 400 can be connected to a power source (not shown).

Figure 11:
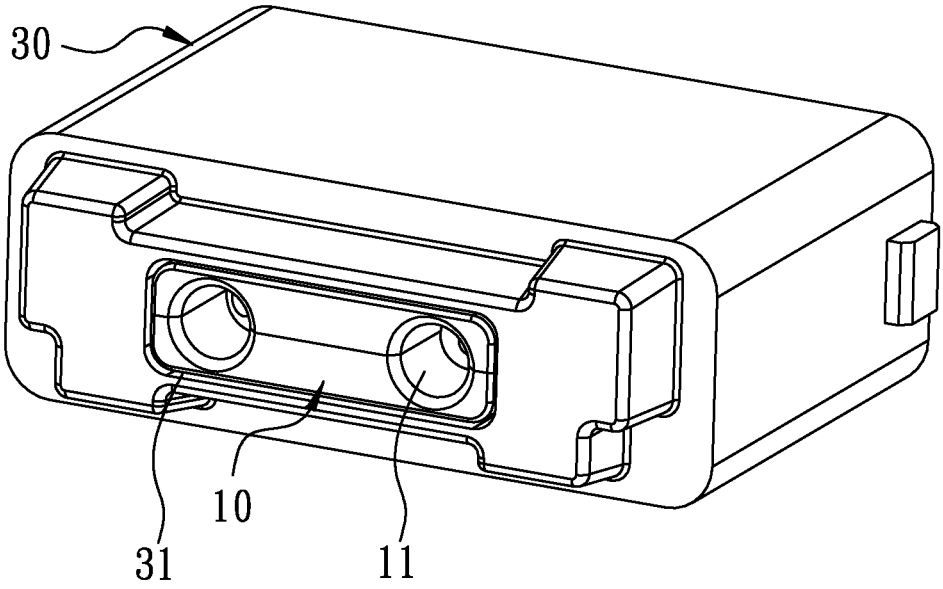
FIG. 11 illustrates three dimension view of the magnetic power connector according to the third embodiment of present invention.
Figure 12:
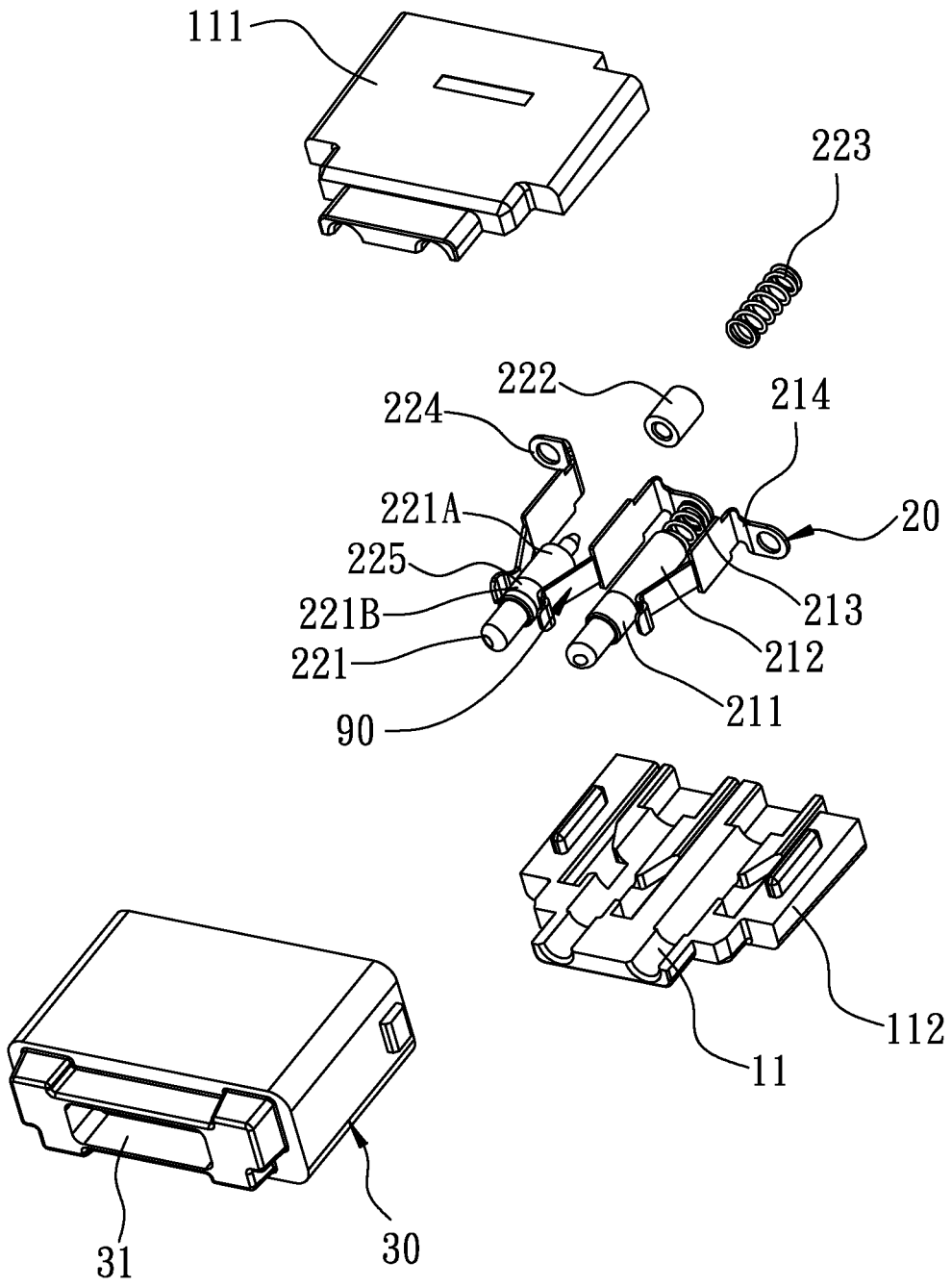
FIG. 12 illustrates an exploded view of the magnetic power connector according to the third embodiment of present invention.
Figure 13:
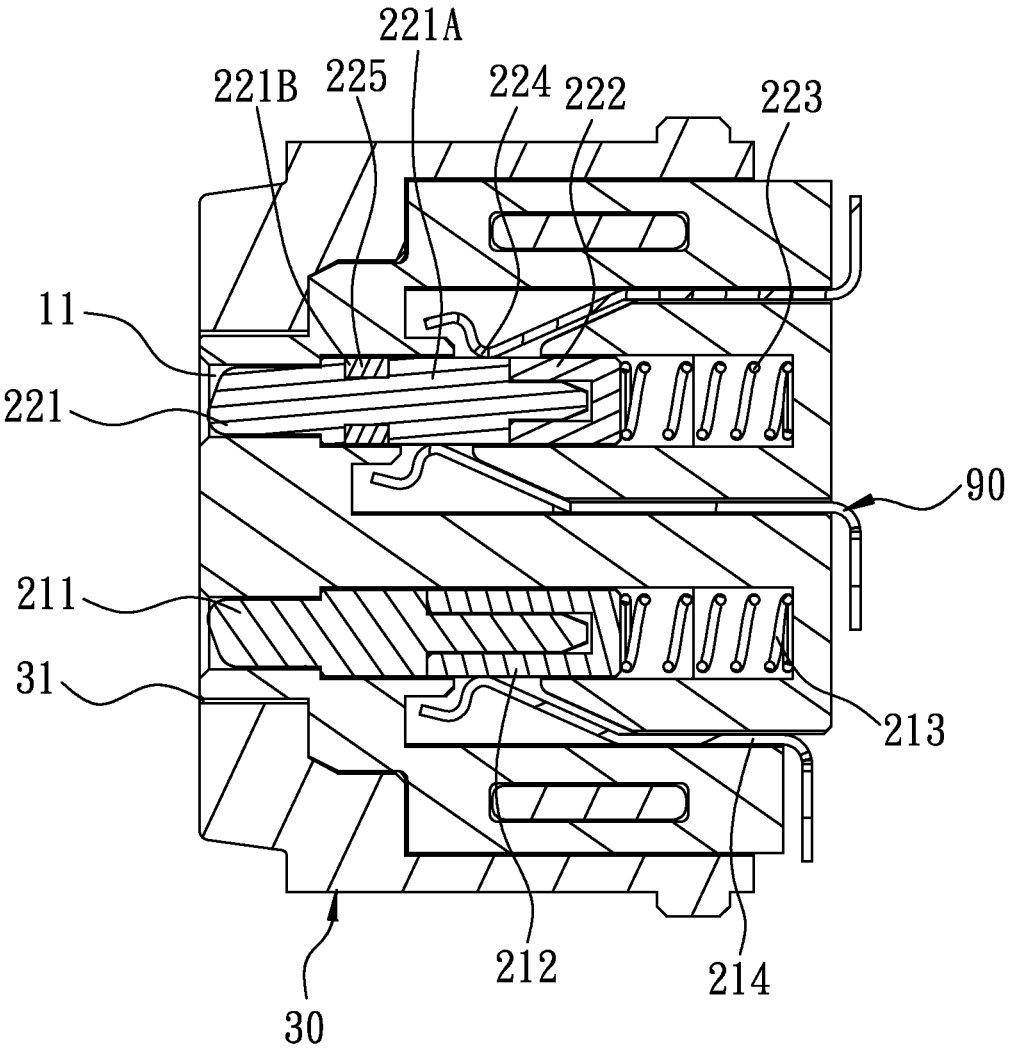
FIG. 13 illustrates a section view of the magnetic power connector according to the third embodiment of present invention.

FIGS. 11 and 12 illustrate three dimension and exploded views according to the third embodiment of present invention. The third embodiment is almost the same as the first embodiment and the major difference between them is described as follows. In the third embodiment, an insulation portion 225 is disposed on the peripheral side surface of a conductive element 221 of the movable contact element 20 so that the conductive element 221 can define a conductive section 221A and an insulation section 221B. In the third embodiment, the insulation portion 225 is disposed on the conductive element 221 of the negative contact element 22. The magnetic power connector 100 further includes a signal contact element 90 having one end pressing against the conductive element 221 of the negative contact element 22. As shown in FIG. 13, under normal condition, the signal contact element 90 is in contact with conductive section 221A, and one end of the elastic conductive element 224 is also in contact with the conductive section 221A to form a conductive path between the elastic conductive element 224 and the signal contact element 90.

Figure 14:
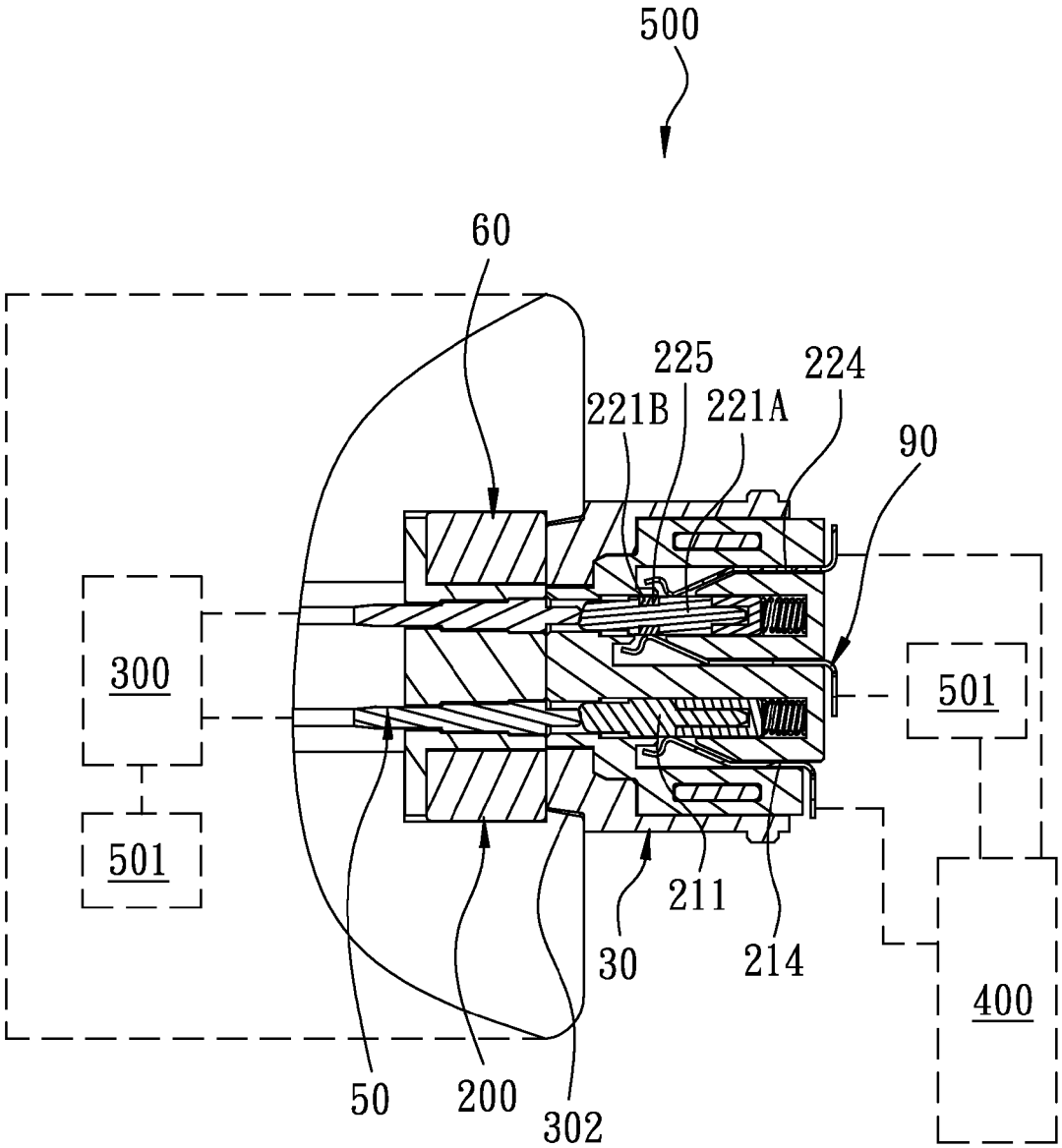
FIG. 14 illustrates the connecting status of the magnetic power connector and the matching magnetic connector according to the third embodiment of present invention.

FIG. 14 illustrates the schematic of the third embodiment of present invention in which the connecting status of the magnetic power connector and the matching magnetic connector is shown. The electronic system 500 in the third embodiment is almost the same as the electronic system described in other embodiments and the major difference between them is described as follows. The electronic system 500 in the third embodiment further includes two wireless control units 501. The wireless control units 501 are electrically connected to the electronic device 300 and the electrical relation 400 respectively. The signal contact element 90 is electrically connected to one of the wireless control units 501. When the magnetic power connector 100 and the matching magnetic connector 200 are coupled, the contact element 90 is in contact with the conductive element 221 so as to move the conductive element 221 towards the elastic element 222. Then the signal contact element 90 will be in contact with the insulation section 221B so as to break the conductive path from the signal contact element 90 to the elastic conductive element 224, thereby creating a trigger signal to drive the wireless control units 501. By means of the structure disclosed in the third embodiment of present invention, the effects of identification or control can be achieved through only the electrical connections of the internal elements of the magnetic power connector 100, so as to avoid functional failures caused by the damage of the contact element 50 of the matching magnetic connector 200. The wireless control units 501 can be communications protocol or other wireless transmission interfaces. In the third embodiment of present invention, the wireless control units 501 can be used to control the electrical relation 400 to supply the power from the magnetic power connector 100 and the matching magnetic connector 200 to the electronic device 300, or can be used for other electrical controls.

What is claimed is:

1. A magnetic power connector for electrically connecting to a matching magnetic connector between an electronic device and an electrical relation connectable to a power source, wherein the matching magnetic connector comprises a second magnetic element and at least one contact element, the magnetic power connector comprising:

an insulation body having at least one passage;

at least one movable contact element disposed in the passage, comprising a conductive element, an insulation block, an elastic element and an elastic conductive element, wherein one end of the conductive element is coupled to the insulation block, and the insulation block is pressed by the elastic element so as to move the conductive element in the passage elastically, wherein one end of the elastic conductive element is connectable to a peripheral side surface of the conductive element elastically; and a first magnetic element disposed on the insulation body;

wherein when the magnetic power connector and the matching magnetic connector are connected, magnetic attraction between the first and second magnetic elements causes the movable contact element being pressed by the contact element to move towards the elastic element so as to form a conductive path through the contact element, the conductive element and the elastic conductive element, between the electronic device and the electrical relation.

2. The magnetic power connector according to claim 1, wherein the at least one movable contact element comprises a plurality of movable contact elements including at least one positive contact element and at least one negative contact element, wherein the elastic conductive element of the positive contact element comes into contact with the insulation block of the positive contact element before the magnetic power connector and the matching magnetic connector are connected, and the conductive element of the positive contact element is moved toward the elastic element of the positive contact element to electrically connect with the elastic conductive element of the positive contact element when the magnetic power connector and the matching magnetic connector are connected; and wherein the elastic conductive element of the negative contact element is permanently against the conductive element of the negative contact element.

3. The magnetic power connector according to claim 1, wherein an insulation part is disposed on the conductive element to define a conductive section and an insulation section; and wherein the magnetic power connector further comprises a signal contact element having one end pressing on the conductive element, wherein the signal contact element comes into contact with the conductive section before the magnetic power connector and the matching magnetic connector are connected, and wherein when the magnetic power connector and the matching magnetic connector are connected, the conductive element moves towards the elastic element so as to allow the signal contact element to make contact with the insulation section so as to switch the contact point of the signal contact element.

4. The magnetic power connector according to claim 3, wherein a conductive path between the elastic conductive element and the signal contact element is formed before the magnetic power connector and the matching magnetic connector are connected, and the electrical conductive path between the elastic conductive element and the signal contact element is broken when the magnetic power connector and the matching magnetic connector are connected.

5. The magnetic power connector according to claim 4, wherein the magnetic power connector further comprises a shell covering the first magnetic element and coupling to the insulation body; and wherein the at least one movable contact element comprising a plurality of movable contact elements, wherein an opening is disposed on the shell to partially expose the first magnetic element, wherein said conductive elements of the plurality of movable contact elements partially extends out of the surface of the first magnetic element and disposed in said opening, wherein the shell further comprises at least one first constrain part extending from the inside wall of the opening toward said conductive elements so as to cover the said conductive elements, wherein the at least one first constrain part prevents the second magnetic element from colliding with the said conductive elements laterally.

6. The magnetic power connector according to claim 2, wherein an insulation part is disposed on the conductive element to define a conductive section and an insulation section; and wherein the magnetic power connector further comprises a signal contact element having one end pressing on the conductive element, wherein the signal contact element comes into contact with the conductive section before the magnetic power connector and the matching magnetic connector are connected, and wherein when the magnetic power connector and the matching magnetic connector are connected, the conductive element moves towards the elastic element so as to allow the signal contact element to make contact with the insulation section so as to switch the contact point of the signal contact element.

7. The magnetic power connector according to claim 6, wherein a conductive path between the elastic conductive element and the signal contact element is formed before the magnetic power connector and the matching magnetic connector are connected, and the electrical conductive path between the elastic conductive element and the signal contact element is broken when the magnetic power connector and the matching magnetic connector are connected.

8. The magnetic power connector according to claim 7, wherein the magnetic power connector further comprises a shell covering the first magnetic element and coupling to the insulation body; and wherein the at least one movable contact element comprising a plurality of movable contact elements, wherein an opening is disposed on the shell to partially expose the first magnetic element, wherein said conductive elements of the plurality of movable contact elements partially extends out of the surface of the first magnetic element and disposed in said opening, wherein the shell further comprises at least one first constrain part extending from the inside wall of the opening toward said conductive elements so as to cover the said conductive elements, wherein the at least one first constrain part prevents the second magnetic element from colliding with the said conductive elements laterally.

9. A electronic system with a magnetic power connector assembly, comprising:

an electronic device having a case including an opening;

a magnetic power connector comprising:

an insulation body having at least one passage;

at least one movable contact element disposed in the passage, comprising a conductive element, an insulation block, an elastic element and an elastic conductive element, wherein one end of the conductive element is coupled to the insulation block, and the insulation block is pressed by the elastic element so as to move the conductive element in the passage elastically, wherein one end of the elastic conductive element is connectable to a peripheral side surface of the conductive element elastically; and a first magnetic element disposed on the insulation body;

a matching magnetic connetor, is connectable to the magnetic power connector, and comprising a second magnetic element and at least one contact element; and a electrical relation connectable to a power source;

wherein the magnetic power connector is electrically connecting to the matching magnetic connector between the electronic device and the electrical relation, the magnetic power connector or the matching magnetic connector is disposed in the case, and the first magnetic element or the second magnetic element is correspondingly exposed in the opening, when the magnetic power connector and the matching magnetic connector are connected, magnetic attraction between the first and second magnetic elements causes the movable contact element being pressed by the contact element to move towards the elastic element so as to form a conductive path through the contact element, the conductive element and the elastic conductive element, between the electronic device and the electrical relation.

10. The electronic system according to claim 9, wherein the at least one movable contact element comprising a plurality of movable contact elements including at least one positive contact element and at least one negative contact element, wherein the elastic conductive element of the positive contact element comes into contact with the insulation block of the positive contact element before the magnetic power connector and the matching magnetic connector are connected, and the conductive element of the positive contact element is moved toward the elastic element of the positive contact element to electrically connect with the elastic conductive element of the positive contact element when the magnetic power connector and the matching magnetic connector are connected; and wherein the elastic conductive element of the negative contact element is permanently against the conductive element of the negative contact element.

11. The electronic system according to claim 9, wherein the conductive element further comprises a conductive section and an insulation section having an insulation portion; and wherein the magnetic power connector further comprises a signal contact element having one end pressing on the conductive element, wherein the signal contact element comes into contact with the conductive section before the magnetic power connector and the matching magnetic connector are connected, and wherein when the magnetic power connector and the matching magnetic connector are connected, the conductive element moves towards the elastic element so as to allow the signal contact element to make contact with the insulation section for generating a trigger signal.

12. The electronic system according to claim 11, further comprising two wireless control units, wherein one of the wireless control units is electrically connected to the signal contact element and driven by switching the contact point of the signal contact element.

13. The electronic system according to claim 12 wherein an electrically conductive path between the elastic conductive element and the signal contact element is formed before the magnetic power connector and the matching magnetic connector are connected, and the electrical conductive path between the elastic conductive element and the signal contact element is broken when the magnetic power connector and the matching magnetic connector are connected.

14. The electronic system according to claim 13, wherein the conductive elements partially extends out of the surface of the first magnetic element and is disposed in the opening, wherein the case further comprises at least one second constrain part extending from the inside wall of the opening toward said conductive elements so as to cover the said conductive elements, wherein, when the magnetic power connector and the matching magnetic connector are connected, the second magnetic element is partially plugged into the opening and the at least one second constrain part prevents the second magnetic element from colliding with the said contact elements laterally.

15. The electronic system according to claim 13, wherein the at least one contact element comprises a plurality of contact elements which are disposed in the opening and partially extend out of the surface of the second magnetic element, wherein the case further comprises at least one second constrain part extending from the inside wall of the opening toward said contact elements so as to cover the said contact elements, wherein, when the magnetic power connector and the matching magnetic connector are connected, the first magnetic element is partially plugged into the opening and the at least one second constrain part prevents the first magnetic element from colliding with the said contact elements laterally.

16. The electronic system according to claim 10, wherein the conductive element further comprises a conductive section and an insulation section having an insulation portion; and wherein the magnetic power connector further comprises a signal contact element having one end pressing on the conductive element, wherein the signal contact element comes into contact with the conductive section before the magnetic power connector and the matching magnetic connector are connected, and wherein when the magnetic power connector and the matching magnetic connector are connected, the conductive element moves towards the elastic element so as to allow the signal contact element to make contact with the insulation section for generating a trigger signal.

17. The electronic system according to claim 16, further comprising two wireless control units, wherein one of the wireless control units is electrically connected to the signal contact element and driven by switching the contact point of the signal contact element.

18. The electronic system according to claim 17 wherein an electrically conductive path between the elastic conductive element and the signal contact element is formed before the magnetic power connector and the matching magnetic connector are connected, and the electrical conductive path between the elastic conductive element and the signal contact element is broken when the magnetic power connector and the matching magnetic connector are connected.

19. The electronic system according to claim 18, wherein the conductive elements partially extends out of the surface of the first magnetic element and is disposed in the opening, wherein the case further comprises at least one second constrain part extending from the inside wall of the opening toward said conductive elements so as to cover the said conductive elements, wherein, when the magnetic power connector and the matching magnetic connector are connected, the second magnetic element is partially plugged into the opening and the at least one second constrain part prevents the second magnetic element from colliding with the said contact elements laterally.

20. The electronic system according to claim 18, wherein the at least one contact element comprises a plurality of contact elements which are disposed in the opening and partially extend out of the surface of the second magnetic element, wherein the case further comprises at least one second constrain part extending from the inside wall of the opening toward said contact elements so as to cover the said contact elements, wherein, when the magnetic power connector and the matching magnetic connector are connected, the first magnetic element is partially plugged into the opening and the at least one second constrain part prevents the first magnetic element from colliding with the said contact elements laterally.

21. A magnetic power connector for electrically connecting to a matching magnetic connector between an electronic device and an electrical relation connectable to a power source, wherein the matching magnetic connector comprises a second magnetic element and at least one contact element, the magnetic power connector comprising:

an insulation body having at least one passage;

at least one movable contact element disposed in the passage, comprising a conductive element, an insulation block, an elastic element and an elastic conductive element, wherein one end of the conductive element is coupled to the insulation block, and the insulation block is pressed by the elastic element so as to move the conductive element in the passage elastically, wherein one end of the elastic conductive element is connectable to a peripheral side surface of the conductive element elastically; and a first magnetic element disposed on the insulation body;

a shell covering the first magnetic element and coupled to the insulation body; wherein an opening is disposed on the shell to partially expose the first magnetic element;

a sealing member disposed between the shell, the insulation body and the magnetic element or between the passage and the movable contact element;

wherein when the magnetic power connector and the matching magnetic connector are connected, magnetic attraction between the first and second magnetic elements causes the movable contact element being pressed by the contact element to move towards the elastic element so as to form a conductive path through the contact element, the conductive element and the elastic conductive element, between the electronic device and the electrical relation.

22. The magnetic power connector according to claim 21, wherein the at least one movable contact element comprising a plurality of movable contact elements including at least one positive contact element and at least one negative contact element, wherein the elastic conductive element of the positive contact element comes into contact with the insulation block of the positive contact element before the magnetic power connector and the matching magnetic connector are connected, and the conductive element of the positive contact element is moved toward the elastic element of the positive contact element to electrically connect with the elastic conductive element of the positive contact element when the magnetic power connector and the matching magnetic connector are connected; and wherein the elastic conductive element of the negative contact element is permanently against the conductive element of the negative contact element.

23. The magnetic power connector according to claim 21, wherein the conductive element further comprises a conductive section and an insulation section having an insulation portion; and wherein the magnetic power connector further comprises a signal contact element having one end pressing on the conductive element, wherein the signal contact element comes into contact with the conductive section before the magnetic power connector and the matching magnetic connector are connected, and wherein when the magnetic power connector and the matching magnetic connector are connected, the conductive element moves towards the elastic element so as to allow the signal contact element to make contact with the insulation section for generating a trigger signal.

24. The magnetic power connector according to claim 23, wherein an electrically conductive path between the elastic conductive element and the signal contact element is formed before the magnetic power connector and the matching magnetic connector are connected, and the electrical conductive path between the elastic conductive element and the signal contact element is broken when the magnetic power connector and the matching magnetic connector are connected.

25. The magnetic power connector according to claim 24, wherein said conductive elements partially extend out of the surface of the first magnetic element and disposed in said opening, wherein the shell further comprises at least one first constrain part extending from the inside wall of the opening toward said conductive elements so as to cover the said conductive elements, wherein, when the magnetic power connector and the matching magnetic connector are connected, the first magnetic element is partially plugged into the opening and the at least one first constrain part prevents the first magnetic element from colliding with the said contact elements laterally.

26. The magnetic power connector according to claim 22, wherein the conductive element further comprises a conductive section and an insulation section having an insulation portion; and wherein the magnetic power connector further comprises a signal contact element having one end pressing on the conductive element, wherein the signal contact element comes into contact with the conductive section before the magnetic power connector and the matching magnetic connector are connected, and wherein when the magnetic power connector and the matching magnetic connector are connected, the conductive element moves towards the elastic element so as to allow the signal contact element to make contact with the insulation section for generating a trigger signal.

27. The magnetic power connector according to claim 26, wherein an electrically conductive path between the elastic conductive element and the signal contact element is formed before the magnetic power connector and the matching magnetic connector are connected, and the electrical conductive path between the elastic conductive element and the signal contact element is broken when the magnetic power connector and the matching magnetic connector are connected.

28. The magnetic power connector according to claim 27, wherein said conductive elements partially extend out of the surface of the first magnetic element and disposed in said opening, wherein the shell further comprises at least one first constrain part extending from the inside wall of the opening toward said conductive elements so as to cover the said conductive elements, wherein, when the magnetic power connector and the matching magnetic connector are connected, the first magnetic element is partially plugged into the opening and the at least one first constrain part prevents the first magnetic element from colliding with the said contact elements laterally.

29. A magnetic power connector assembly for electrically connecting between an electronic device and an electrical relation connectable to a power source, the magnetic power connector assembly comprising:

a magnetic power connector, comprising:

an insulation body having at least one passage;

at least one movable contact element disposed in the passage, comprising a conductive element, an insulation block, an elastic element and an elastic conductive element, wherein one end of the conductive element is coupled to the insulation block, and the insulation block is pressed by the elastic element so as to move the conductive element in the passage elastically, wherein one end of the elastic conductive element is connectable to a peripheral side surface of the conductive element elastically; and a first magnetic element disposed on the insulation body; and a matching magnetic connector for electrically connecting to the magnetic power connector, comprising:

an insulation host including at least one through hole;

at least one contact element disposed in the through hole;

a second magnetic element disposed on the insulation host;

a shell covering the second magnetic element and coupled to the insulation host, wherein the shell comprises an opening to partially expose the second magnetic element;

a sealing member disposed between the shell, the insulation host and the magnetic element or between the through hole and the movable contact element;

wherein when the magnetic power connector and the matching magnetic connector are connected, magnetic attraction between the first and second magnetic elements causes the movable contact element being pressed by the contact element to move towards the elastic element so as to form a conductive path through the contact element, the conductive element and the elastic conductive element, between the electronic device and the electrical relation.

30. The magnetic power connector assembly according to claim 29, wherein the at least one movable contact element comprising a plurality of movable contact elements including at least one positive contact element and at least one negative contact element, wherein the elastic conductive element of the positive contact element comes into contact with the insulation block of the positive contact element before the magnetic power connector and the matching magnetic connector are connected, and the conductive element of the positive contact element is moved toward the elastic element of the positive contact element to electrically connect with the elastic conductive element of the positive contact element when the magnetic power connector and the matching magnetic connector are connected; and wherein the elastic conductive element of the negative contact element is permanently against the conductive element of the negative contact element.

31. The magnetic power connector assembly according to claim 29, wherein the conductive element further comprises a conductive section and an insulation section having an insulation portion; and wherein the magnetic power connector further comprises a signal contact element having one end pressing on the conductive element, wherein the signal contact element comes into contact with the conductive section before the magnetic power connector and the matching magnetic connector are connected, and wherein when the magnetic power connector and the matching magnetic connector are connected, the conductive element moves towards the elastic element so as to press the signal contact element to make contact with the insulation section.

32. The magnetic power connector assembly according to claim 31, wherein an electrically conductive path between the elastic conductive element and the signal contact element is formed before the magnetic power connector and the matching magnetic connector are connected, and the electrical conductive path between the elastic conductive element and the signal contact element is broken when the magnetic power connector and the matching magnetic connector are connected.

33. The magnetic power connector assembly according to claim 32, wherein the at least one contact element comprises a plurality of contact elements, wherein said contact elements partially extend out of the surface of the second magnetic element and is disposed in the opening, wherein the shell further comprises at least one first constrain part extending from the inside wall of the opening toward said contact elements so as to cover the said contact elements, wherein, when the magnetic power connector and the matching magnetic connector are connected, the first magnetic element is partially plugged into the opening and the at least one first constrain part prevents the first magnetic element from colliding with the said contact elements laterally.

34. The magnetic power connector assembly according to claim 30, wherein the conductive element further comprises a conductive section and an insulation section having an insulation portion; and wherein the magnetic power connector further comprises a signal contact element having one end pressing on the conductive element, wherein the signal contact element comes into contact with the conductive section before the magnetic power connector and the matching magnetic connector are connected, and wherein when the magnetic power connector and the matching magnetic connector are connected, the conductive element moves towards the elastic element so as to press the signal contact element to make contact with the insulation section.

35. The magnetic power connector assembly according to claim 34, wherein an electrically conductive path between the elastic conductive element and the signal contact element is formed before the magnetic power connector and the matching magnetic connector are connected, and the electrical conductive path between the elastic conductive element and the signal contact element is broken when the magnetic power connector and the matching magnetic connector are connected.

36. The magnetic power connector assembly according to claim 35, wherein the at least one contact element comprises a plurality of contact elements, wherein said contact elements partially extend out of the surface of the second magnetic element and is disposed in the opening, wherein the shell further comprises at least one first constrain part extending from the inside wall of the opening toward said contact elements so as to cover the said contact elements, wherein, when the magnetic power connector and the matching magnetic connector are connected, the first magnetic element is partially plugged into the opening and the at least one first constrain part prevents the first magnetic element from colliding with the said contact elements laterally.

* * * * *